United States Patent [19]

Fukuroi

[11] 3,953,912

[45] May 4, 1976

[54] CONCEALED SLIDING CLASP FASTENER

[75] Inventor: Takeo Fukuroi, Uozu, Japan

[73] Assignee: Yoshida Kogyo Kabushiki Kaisha, Japan

[22] Filed: June 21, 1971

[21] Appl. No.: 155,046

[30] Foreign Application Priority Data

July 8, 1970 Japan ..... 45-59739

[52] U.S. Cl. ..... 24/205 R; 24/205.11 R; 24/205.1 R

[51] Int. Cl.[2] ..... A44B 19/02; A44B 19/36

[58] Field of Search ..... 24/205.11, 205, 205.1

[56] References Cited

UNITED STATES PATENTS

| | | | |
|---|---|---|---|
| 2,224,930 | 12/1940 | Roseman | 24/205.1 R |
| 2,306,488 | 12/1942 | Morner | 24/205.1 R |
| 2,358,816 | 8/1944 | Morner | 24/207 |
| 2,972,751 | 2/1961 | Leonard | 24/205.1 R |
| 2,989,802 | 6/1961 | McNamara | 24/205.1 R |
| 3,077,651 | 2/1963 | Morin | 24/205.11 R |
| 3,077,847 | 2/1967 | Morin | 24/205.1 R |
| 3,225,429 | 12/1965 | Fady | 24/205 R |
| 3,516,409 | 6/1970 | Howell | 24/205 R |
| 3,555,627 | 1/1971 | Howell | 24/205.11 R |

*Primary Examiner*—Bernard A. Gelak
*Attorney, Agent, or Firm*—Bucknam and Archer

[57] ABSTRACT

A concealed sliding clasp fastener is described, which fastener is provided with an adjustable end stop movably mounted on interengaged rows of coupling elements and positioned between a slider and a permanently secured bottom stop. The adjustable end stop may be secured by clamping or by fusion to adjacent coupling elements at any desired position on the fastener, after the latter is applied to a garment.

1 Claim, 9 Drawing Figures

INVENTOR.
TAKEO FUKUROI

BY

INVENTOR.
TAKEO FUKUROI

BY

CONCEALED SLIDING CLASP FASTENER

This invention relates to a concealed sliding-clasp fastener and its chain, more particularly to those which are provided with end stops movably mounted on the coupling elements to be clamped into position where desired on the fastener tapes.

When attaching a concealed sliding clasp fastener to a garment or the like, it is the usual practice to adjust the slider to a position in abutment to the bottom stop which secures the two opposed stringer tapes together at a permanently closed end of the fastener, so as to clear the passage of a presser foot. The fastener is thus attached to marginal portions of the garment by a stitching provided as close as possible to the rows of coupling elements which are mounted along the longitudinal edges of the stringer tapes and which are in a sewing disposition held substantially perpendicularly to the plane of the fastener with the aid of a presser foot. The stitching extends up to and terminates at a point adjacent to the front wing of the slider with the results that the portion of the element-carrying edge of the respective stringer tape which has been occupied by the slider is not sewn onto the garment. Upon completion of the sewing operation, the slider is moved forwardly towards an open end of the fastener to bring the coupling elements into engagement and close the fastener. Thereafter, the portions of the marginal edges of the garment, which extend between the bottom stop and the terminal end of the stitching and which have been left unsewn, are stitched together to complete the fastener-attaching operation. Such conventional operation is literally time-consuming and tedious. Furthermore, when opening the fastener thus attached to the garment, the slider abuts directly against the stitched marginal edges of the garment and cannot be brought desirably into abutting relation to the permanently secured bottom stop. Repeated usage of a fastener in such condition has indicated that there is a tendency for the slider to rub against the surfaces of the garment stitched together adjacent to the bottom stop, and these surfaces exhibit wear.

Whereas, the present invention has for its object to eliminate the foregoing disadvantages heretofore encountered in the attachment of a concealed sliding clasp fastener to a garment.

This object is best achieved by preferred embodiments of the invention described hereinafter with reference to the accompanying drawings in which:

FIG. 1 is a plan view showing the reverse side of a concealed sliding clasp fastener embodying the invention;

FIG. 2*a* is a perspective view showing a preferred form of an adjustable end stop member according to the invention;

FIG. 2*b* is a view similar to FIG. 2*a* but showing a modification thereof;

FIG. 3 is a cross-sectional view taken on line III—III of FIG. 1;

FIGS. 4*a*, 4*b* and 4*c*, inclusive, show the successive steps of applying a concealed sliding clasp fastener to a garment in accordance with the invention;

Figure 1:
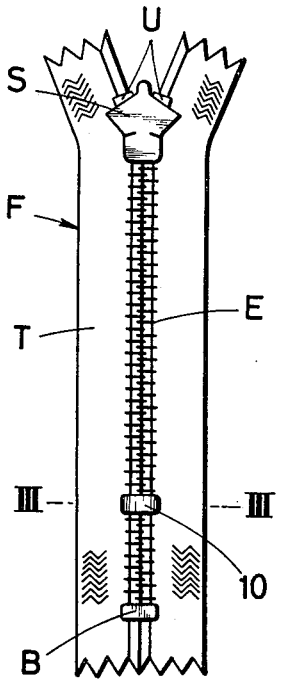
Figure 2A:
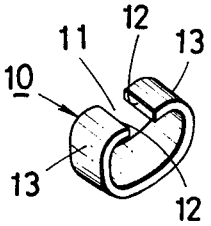
Figure 2B:
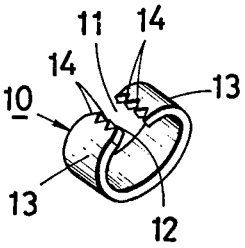
Figure 3:
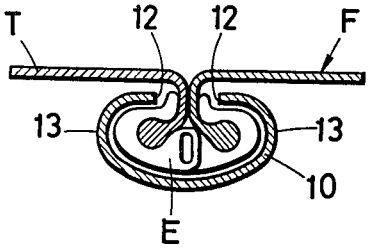
Figure 4A:
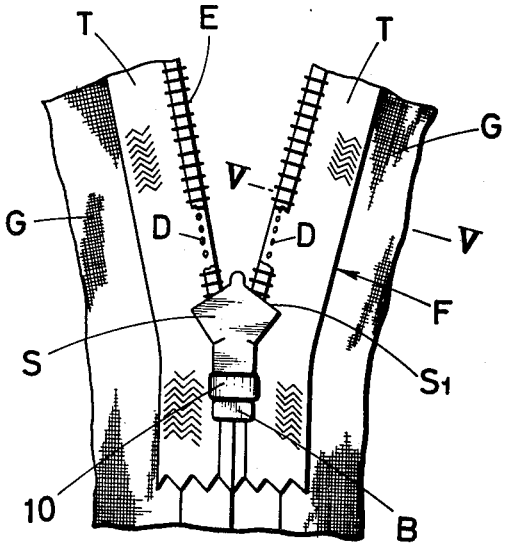
Figure 4B:
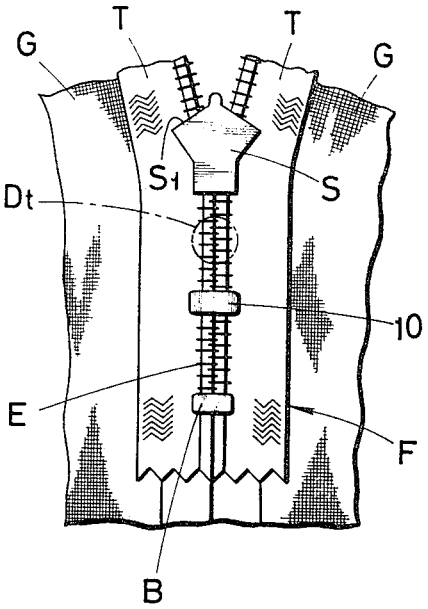
Figure 4C:
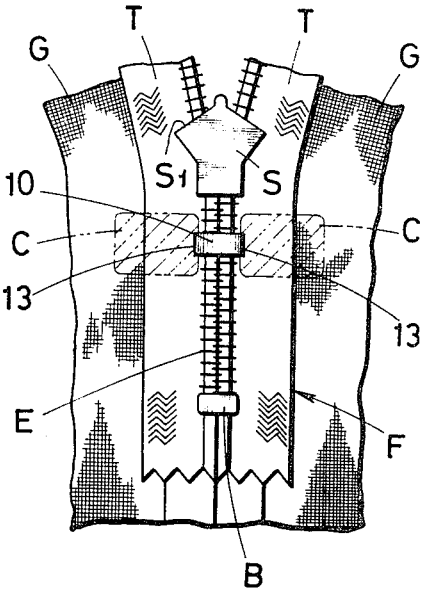
Figure 5:
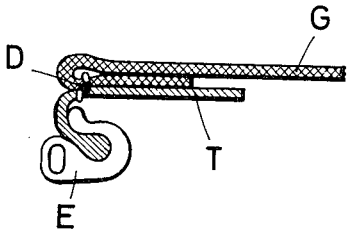
FIG. 5 is a cross-sectional view taken on line V—V of FIG. 4*a;*.

According to the invention, there is provided an adjustable end stop member 10 in the form of an oval loop having an opening 11 defined by opposed clamping edges 12. This stop member 10 may be metallic or plastic, whichever is preferred with the type of a concealed sliding clasp fastener on which it is used. The member 10 is so configured as to fit around adjacent engaged coupling elements E and adapted to freely move astride the rows of elements E extending along the longitudinal edges of stringer tapes T. When applying the adjustable end stop 10 to a concealed sliding clasp fastener F, it is threaded through an open end of the fastener F having top stops U and moved with a slider S along the rows of elements E until it abuts against a bottom stop B at a closed end of the fastener F. With the slider S and adjustable end stop 10 thus retracted together at the closed end, the stringer tapes T are separated as shown in FIG. 4*a* and are sewn closely along marginal portions of a garment G as at D substantially up to the front wing $S_1$ with the aid of a presser foot in the usual manner. Stitching D thus terminates at a point Dt adjacent to the front wing $S_1$ of the slider S. As shown in FIG. 4*b*, the slider S is now moved towards the open end of the fastener F past the terminal point Dt of stitching D. The adjustable end stop 10 is also moved after the slider S and brought into register with the terminal point Dt, where the end stop 10 is clamped into position on the elements E of the fastener F. More specifically, the end stop 10 is preferably pressed inwardly from opposite sides 13 until its clamping edges 12 are securely anchored at the elementcarrying thickened edges of the stringer tapes T by means of a suitable clamping device schematically shown at C in FIG. 4*c*. The end stop 10 thus serves to secure the two opposed stringer tapes together permanently at the closed end of the fastener F and stop the movement of the slider S desirably thereat without causing the slider S to rub against the garment fabric as experienced in the conventional practice. There is shown in FIG. 2*b* a modification of the end stop 10 in which the clamping edges 12 are provided with saw teeth 14 to ensure more rigid securing of the stop 10 on the elements E of the fastener F. It will be understood that the adjustable end stop 10, if made of a plastic material, may be conveniently secured by fusion to the coupling elements E.

Figure 6:
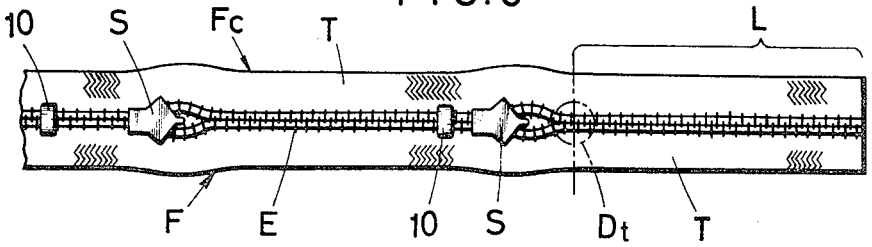
FIG. 6 is a plan view showing the reverse side of a continuous chain of concealed sliding clasp fasteners carrying at suitable intervals the said adjustable end stop members and sliders.

Referring now to FIG. 6, there is shown a continuous chain of concealed sliding clasp fasteners Fc carrying at suitable intervals a plurality of alternate end stops 10 and sliders S, but no bottom stops B are provided. When applying such fastener chain Fc to a garment G, the stringer tapes T are separated and thereafter sewn along marginal portions of a desired length L of the garment G. Upon completion of a cycle of stitching operation, the slider S is moved in a direction to close the fastener F, and the end stop 10 is brought into register with a terminal point of stitching Dt and secured thereat on the fastener F in the manner already described. The cycle of stitching operation may be repeated for the rest of the individual lengths of fastener F in the chain Fc, wherein there is provided a permanently closed end where desired in a given length of sewn fastener by adjusting the position of the end stop 10.

Having thus described the invention, it will be understood that as compared to the conventional manner of attaching a concealed sliding clasp fastener to a garment, the rate of this fastener attachment according to the invention is increased manifold.

What is claimed is:

1. A concealed sliding clasp fastener chain comprising, in combination, a pair of continuous length stringer tapes each carrying a row of coupling elements, said coupling elements of one row interengaged with the coupling elements in the other row along length portions a plurality of separate sliders and a plurality of adjustable end stops separate from said sliders mounted at selected intervals on the rows of coupling elements for movement therealong independent of the movement of said sliders, said adjustable end stops being mounted over said coupling elements at said length portions thereof, each of said end stops having an inside surface forming a generally uniform channel, which surface extends transversely about and in close proximity to the outside surface defined by the interengaged coupling elements to accommodate such movement therealong so that said stops are substantially permanently mounted on said coupling elements and slidable therealong.

* * * * *